US006532603B1

(12) United States Patent
Lan

(10) Patent No.: US 6,532,603 B1
(45) Date of Patent: Mar. 18, 2003

(54) SWIM GOGGLES

(76) Inventor: Shun-Nan Lan, 3, Lane 183, Chung Hsing Rd., Hsi Chih Town, Taipei Hsiang (TW)

( * ) Notice: Subject to any disclaimer, the term of this patent is extended or adjusted under 35 U.S.C. 154(b) by 0 days.

(21) Appl. No.: 09/987,301

(22) Filed: Nov. 14, 2001

(51) Int. Cl.[7] ..... A61F 9/02
(52) U.S. Cl. ..... 2/428; 2/452
(58) Field of Search ..... 2/428, 430, 452, 2/426, 439, 440; 351/43

(56) References Cited

U.S. PATENT DOCUMENTS 6,349,419 B1 * 2/2002 Chiang ..... 2/428
6,367,091 B1 * 4/2002 Chiang ..... 2/428
6,460,196 B2 * 10/2002 Tsubooka et al. ..... 2/428

* cited by examiner

*Primary Examiner*—Peter Nerbun
(74) *Attorney, Agent, or Firm*—Bacon & Thomas, PLLC

(57) ABSTRACT

A swim goggles comprises a frame including two frame elements, two arcuate grooves, and extensions on either end, two fastening assemblies on either side each including an inner buckle member, two opposite gaps, a tongue between gaps, two inner rails, a groove between rails with the guide rails inserted therein for fastening frame elements, and a slit, a lens assembly including a main lens, two side lenses, two protrusions at a bridge thereof with the lens assembly fitted in arcuate grooves, a rear mask assembly including an annular flange, a flared protective covering, an annular groove fitted with the lens assembly, latched members, and two holes, and a strap passed through slits from one side of the frame to the slits on the other side of the frame for coupling fastening assemblies together.

2 Claims, 6 Drawing Sheets

SWIM GOGGLES

FIELD OF THE INVENTION

The present invention relates to swim goggles and more particularly to such a swim goggles with improved characteristics.

BACKGROUND OF THE INVENTION

A conventional swim goggles shown in FIG. 1 comprises a front rigid member 11, a lens assembly 12 having a main lens 13 and two side lenses 14 glued together with main lens 13 so as to obtain a wide viewing, a mask 15 fitted to edge of rigid member 11, and a rear frame 16 with mask 15 fitted thereon. However, the prior art suffered from several disadvantages. For example, it is not waterproof. Further, the assembly process is complex and time consuming. Thus improvement can exist.

SUMMARY OF THE INVENTION

It is therefore an object of the present invention to provide a swim goggles having the advantages of integrally formed lens assembly, durable, easy assembly, more wide viewing, and being waterproof.

To achieve the above and other objects, the present invention provides a swim goggles comprising a front frame including an upper frame element, a lower frame element, a central bridge coupling the upper and the lower frame elements together, an upper arcuate groove, a lower arcuate groove, an upper extension on either side end, a lower extension on either side end, the upper extension including an inner stop, an outer stop, a recess, a stud projected inward from an edge of the recess, a projection at a lower portion of the recess, a shaft having a top dent with the stud received therein and a bottom end situated between the edge of the recess and the projection, a slot at a rear side of the recess, and a first slit, an upper guide rail adjacent the upper extension, and a lower guide rail adjacent the lower extension; two fastening assemblies on either side of the frame and each including a hollow body, an inner buckle member on an outer surface snapped between the inner and the outer stops, two opposite gaps on the outer surface, a tongue between the gaps, a pair of inner rails on the outer surface, a groove between the rails with the upper and the lower guide rails inserted therein for fastening the upper and the lower frame elements, and a second slit on an inner surface aligned with the first slit; a lens assembly including a main lens, two side lenses integrally formed with the main lens, an upper protrusion, and a lower protrusion both at a bridge portion thereof wherein the lens assembly is fitted in the upper and the lower arcuate grooves; a rear mask assembly including an annular flange, a flared protective covering, an annular groove fitted with an outer edge of the lens assembly, a vertical connection member at a bridge portion thereof, an upper latched member, a lower latched member, an upper hole on the upper latched member with the upper protrusion fitted therein, and a lower hole on the lower latched member with the lower protrusion fitted therein; and a strap passed through the first and the second slits from one side of the frame to the first and the second slits on the other side of the frame for coupling the frame and the fastening assemblies together.

The above and other objects, features and advantages of the present invention will become apparent from the following detailed description taken with the accompanying drawings.

DETAILED DESCRIPTION OF THE PREFERRED EMBODIMENTS

Figure 1:
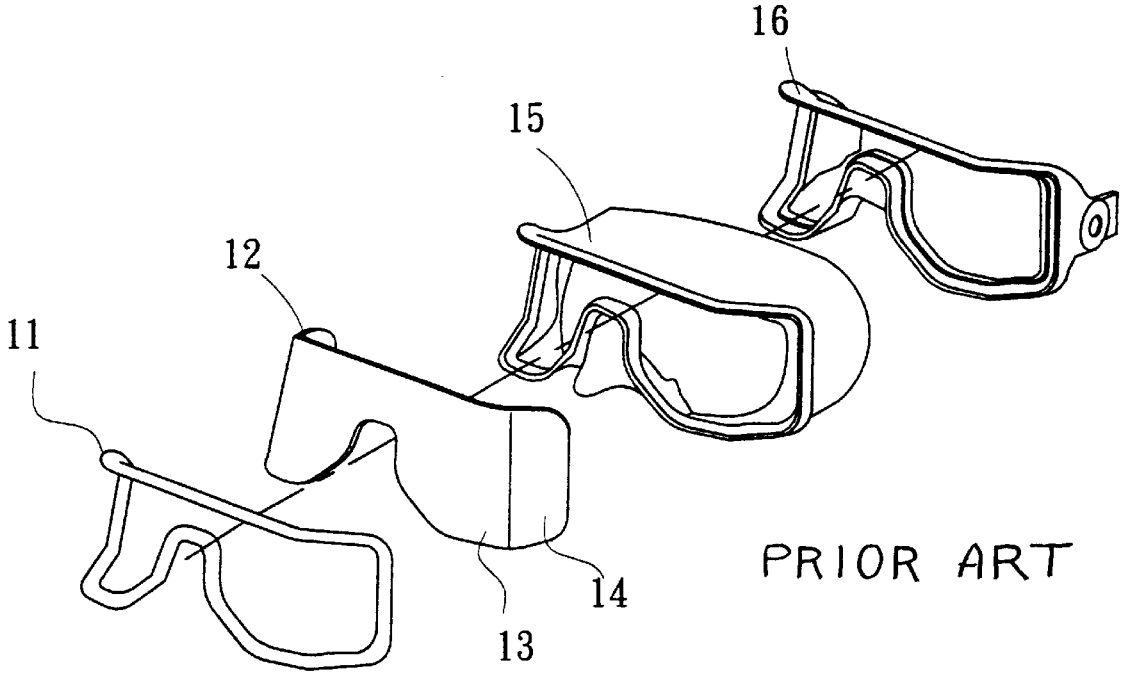
FIG. 1 is an exploded view of a conventional swim goggles.
Figure 2:
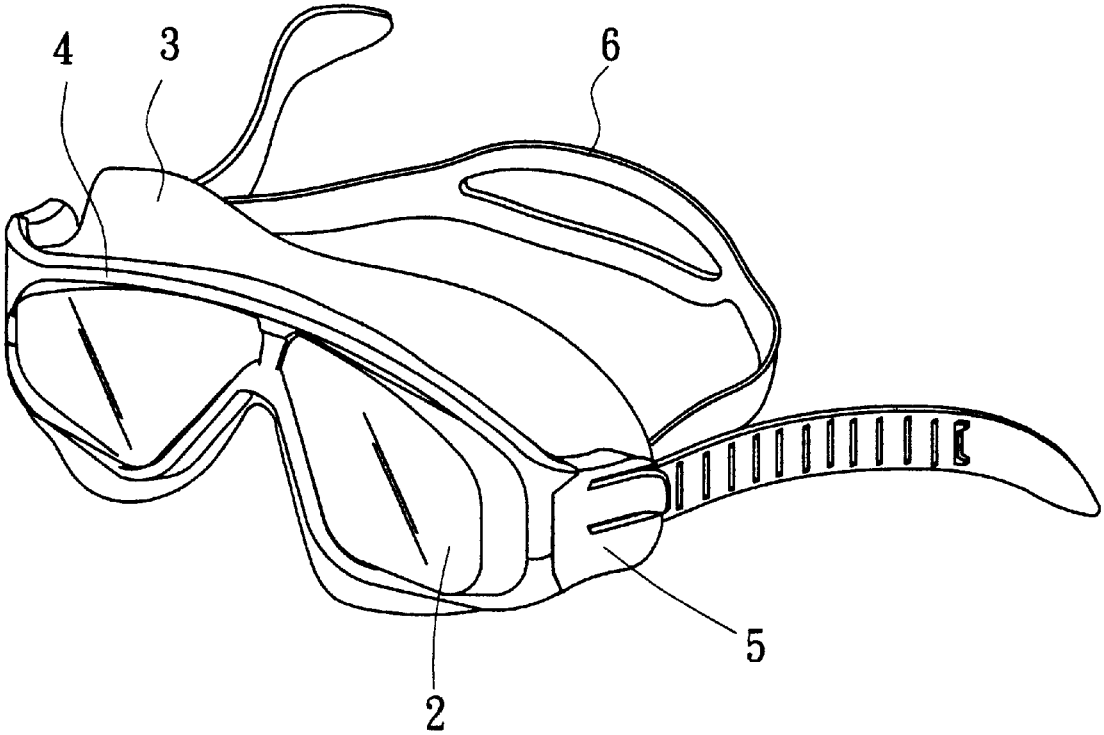
FIG. 2 is a front perspective view of a swim goggles according to the invention.
Figure 3:
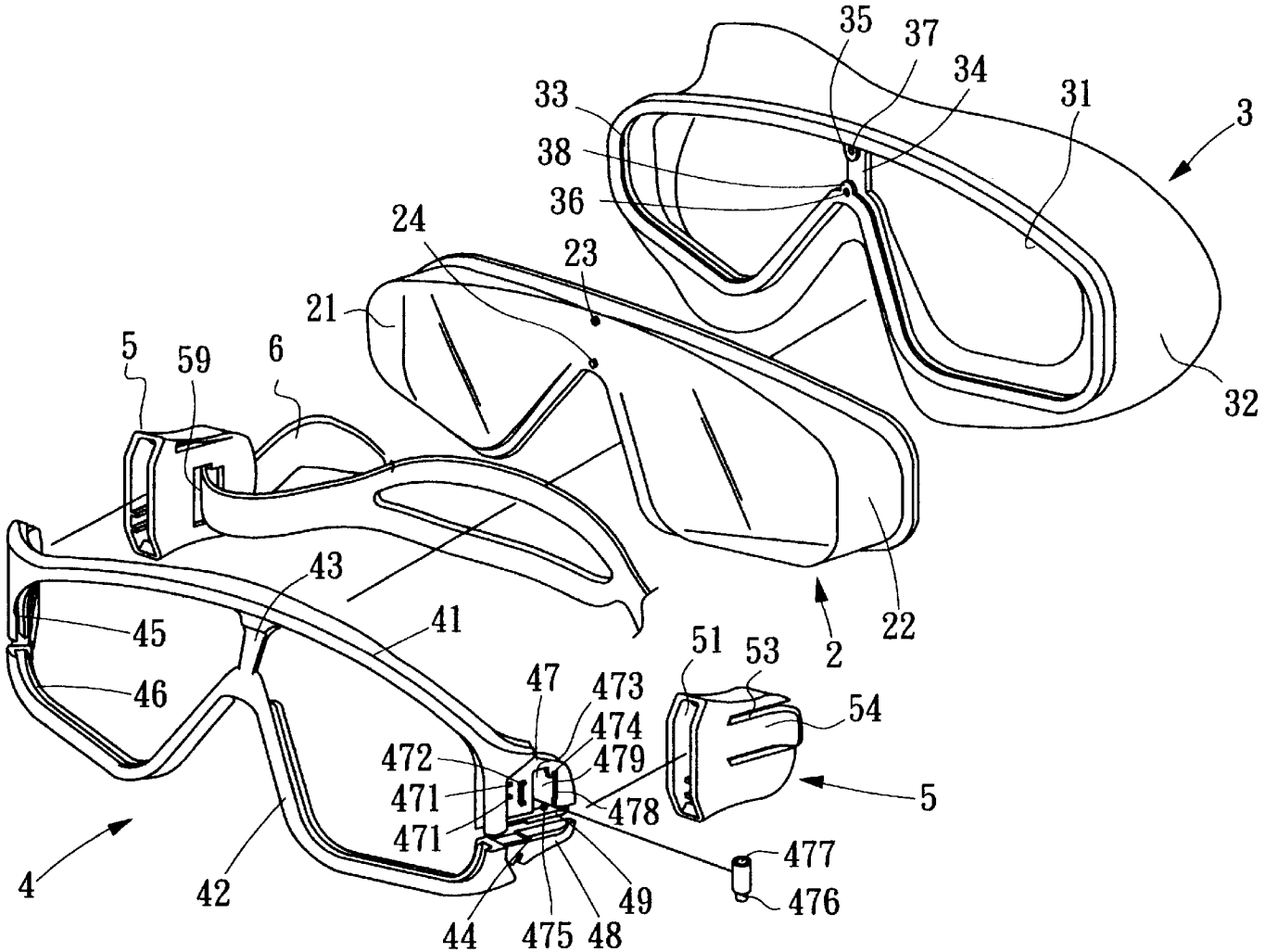
FIG. 3 is an exploded view of FIG. 2 swim goggles.
Figure 4:
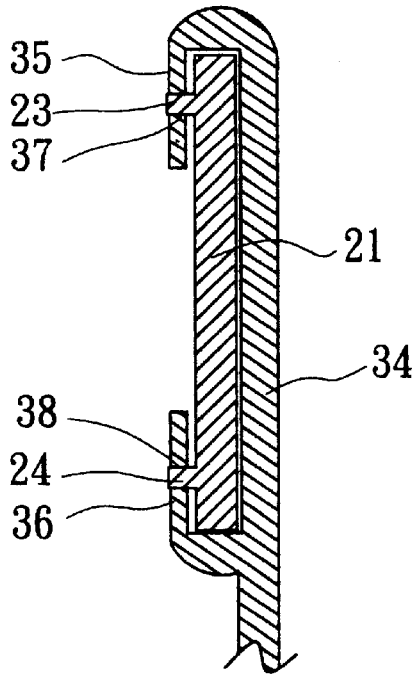
FIG. 4 is a cross-sectional view showing assembled lens assembly and mask assembly around connection member of mask assembly.
Figure 5:
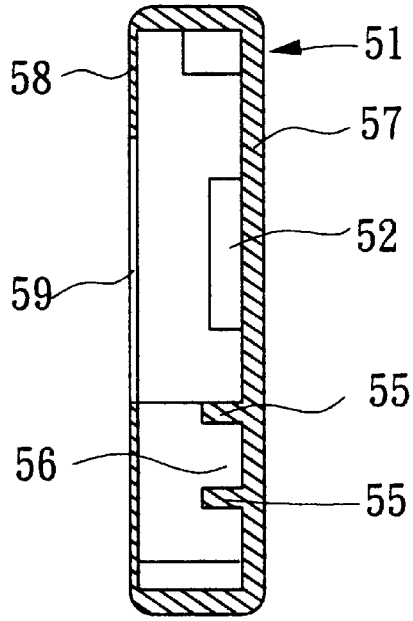
FIG. 5 is a cross-sectional view of fastening assembly.
Figure 6:
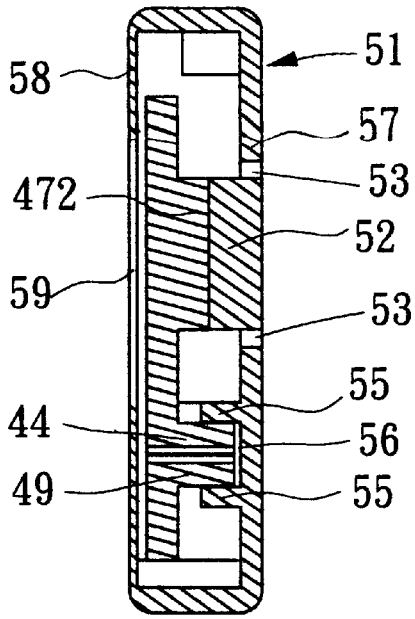
FIG. 6 is a cross-sectional view showing an assembled fastening assembly and an endpiece of frame.
Figure 7:
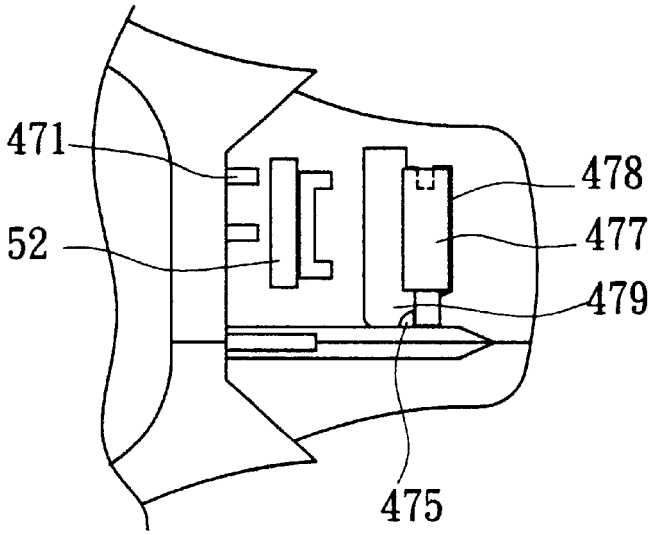
FIG. 7 is another cross-sectional view showing an assembled fastening assembly and endpiece of a frame.
Figure 8:
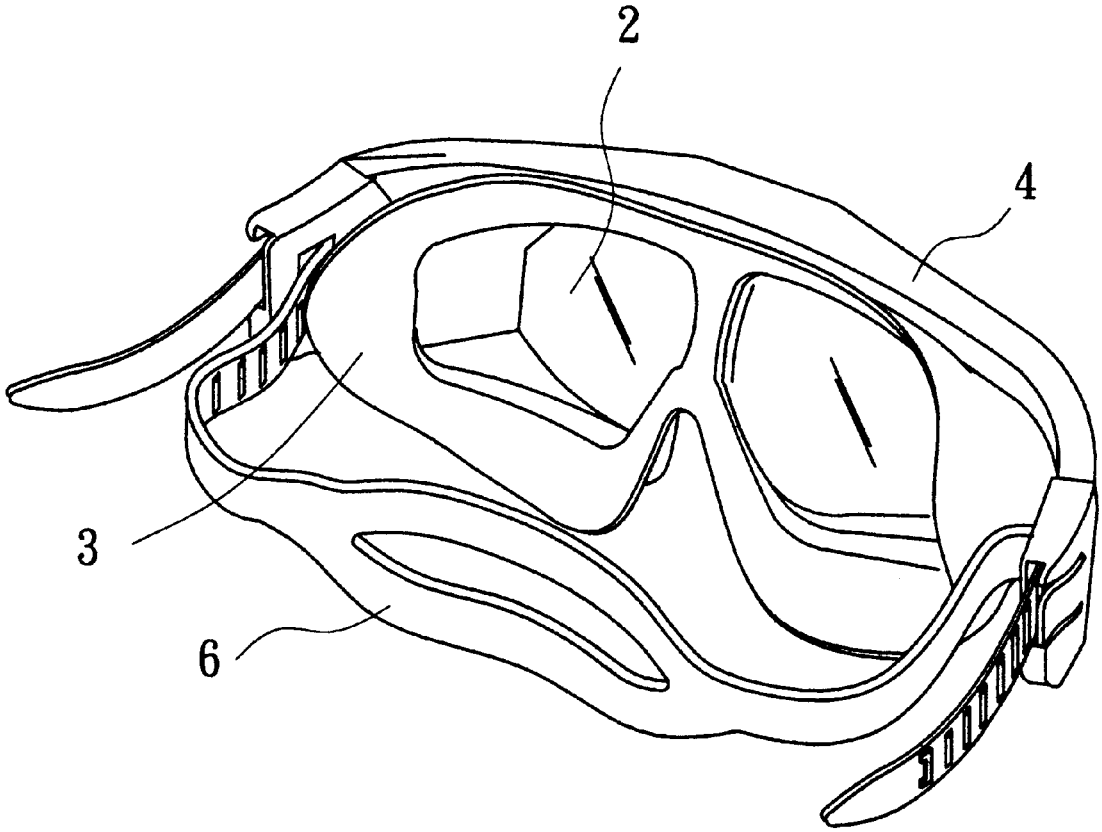
FIG. 8 is a rear perspective view of the FIG. 2 swim goggles.

Referring to FIGS. 2 to 8, there is shown a swim goggles constructed in accordance with the invention comprising a front frame 4, two fastening assemblies 5 on either side of frame 4, a strap 6 coupled between fastening assemblies 5, a lens assembly 2, and a rear mask assembly 3. Each of above components will be described in detail below.

Lens assembly 2 comprises a main lens 21, two side lenses 22 integrally formed with main lens 22 so as to obtain a wide viewing, an upper protrusion 23, and a lower protrusion 24 both at bridge portion thereof. Mask assembly 3 comprises an annular flange 31, a flared protective covering 32, an annular groove 33 fitted with outer edge of lens assembly 2, a vertical connection member 34 at a bridge portion thereof, an upper latched member 35, a lower latched member 36, an upper hole 37 on upper latched member 35 with upper protrusion 23 fitted therein, and a lower hole 38 on lower latched member 36 with lower protrusion 24 fitted therein. Frame 4 is integrally formed and comprises an upper frame element 41, a lower frame element 42, a central bridge 43 coupling upper frame element 41 and lower frame element 42 together, an upper arcuate groove 45, a lower arcuate groove 46 with lens assembly 2 fitted in upper arcuate groove 45 and lower arcuate groove 46, an upper extension 47 on either side end, a lower extension 48 on either side end, upper extension 47 including an inner stop 471, an outer stop 472, a recess 473, a stud 474 projected inward from the edge of recess 473, a projection 475 at lower portion of recess 473, a shaft 476 having a top dent 477 with stud 474 received therein and a bottom end situated between the edge of recess 473 and projection 475, a side slot 478 at the rear side of recess 473, and a slit 479 with strap 6 passed there through each of upper extension 47 and lower extension 48 having a thickness smaller than that of upper frame element 41 or lower frame element 42, an upper guide rail 49 adjacent upper extension 47, and a lower guide rail 44 adjacent lower extension 48. Fastening assembly 5 comprises a hollow body 51, an inner buckle member 52 on outer surface 57 snapped between inner and outer stops 471 and 472 (FIG. 7), two opposite gaps 53 on outer surface 57, a tongue 54 between gaps 53, a pair of inner rails 55 on outer surface 57, a groove 56 between rails 55 with upper guide rail 49 and lower guide rail 44 inserted therein for fastening upper frame element 41 and lower frame element 42 (FIG. 6), and a slit 59 on inner surface 58 aligned with slit 479 so that strap 6 may pass through slits 59 and 479.

While the invention has been described by means of specific embodiments, numerous modifications and variations could be made thereto by those skilled in the art without departing from the scope and spirit of the invention set forth in the claims.

What is claimed is:

1. A swim goggles comprising:

a front frame including an upper frame element, a lower frame element, a central bridge coupling the upper and the lower frame elements together, an upper arcuate groove, a lower arcuate groove, an upper extension on either side end, a lower extension on either side end, the upper extension including an inner stop, an outer stop, a recess, a stud projected inward from an edge of the recess, a projection at a lower portion of the recess, a shaft having a top dent with the stud received therein and a bottom end situated between the edge of the recess and the projection, a slot at a rear side of the recess, and a first slit, an upper guide rail adjacent the upper extension, and a lower guide rail adjacent the lower extension;

two fastening assemblies on either side of the frame and each including a hollow body, an inner buckle member on an outer surface snapped between the inner and the outer stops, two opposite gaps on the outer surface, a tongue between the gaps, a pair of inner rails on the outer surface, a groove between the rails with the upper and the lower guide rails inserted therein for fastening the upper and the lower frame elements, and a second slit on an inner surface aligned with the first slit;

a lens assembly including a main lens, two side lenses integrally formed with the main lens, an upper protrusion, and a lower protrusion both at a bridge portion thereof wherein the lens assembly is fitted in the upper and the lower arcuate grooves;

a rear mask assembly including an annular flange, a flared protective covering, an annular groove fitted with an outer edge of the lens assembly, a vertical connection member at a bridge portion thereof, an upper latched member, a lower latched member, an upper hole on the upper latched member with the upper protrusion fitted therein, and a lower hole on the lower latched member with the lower protrusion fitted therein; and a strap passed through the first and the second slits from one side of the frame to the first and the second slits on the other side of the frame for coupling the frame and the fastening assemblies together.

2. The swim goggles of claim 1, wherein each of the upper and the lower extensions has a thickness smaller than that of each of the upper and the lower frame elements.

* * * * *